United States Patent [19]

Goldberg

[11] Patent Number: 4,690,653

[45] Date of Patent: Sep. 1, 1987

[54] NOISE MAKING MASK

[76] Inventor: Mel Goldberg, c/o Topstone Industries, Inc., 2 Augusta Dr., Danbury, Conn. 06810

[21] Appl. No.: 784,360

[22] Filed: Oct. 3, 1985

[51] Int. Cl.[4] ..... A63H 5/00

[52] U.S. Cl. ..... 446/27; 2/173; 2/206; 446/397

[58] Field of Search ..... 446/26, 27, 28, 303, 446/297, 397, 485, 299, 302, 404; 2/206, 9, 202, 173

[56] References Cited

U.S. PATENT DOCUMENTS 4,282,680 8/1981 Zaruba ..... 446/485 X
4,400,591 8/1983 Jennings et al. ..... 446/27 X

FOREIGN PATENT DOCUMENTS 119155 9/1930 Austria ..... 2/206

*Primary Examiner*—Mickey Yu

*Attorney, Agent, or Firm*—Schweitzer & Cornman

[57] ABSTRACT

An over-the-head face mask is provided with a completely self-contained, electrical noise generating system. The noise generator comprises a speaker, a signal generating electrical circuit, a battery or other power supply and wires connecting the electrical components together. In addition, an on/off switch can be provided in the electrical circuit. Light emitting diodes, located as pupils of the fake eyes of the face mask are also connected in the electrical circuit so that they light up when the electrical circuit is closed. The noise generating speaker of the electrical system is located in a protuberance of the face portion of the face mask. Preferably, the protuberance is an integral disguise feature of the face mask and, therefore, the speaker is camouflaged, self-contained and yet capable of transmitting an unmuffled sound. In this manner, the speaker is hidden from view and, yet, is located proximal to the face mask to provide realistic sound or noises apparently emanating from the front of the face mask.

5 Claims, 5 Drawing Figures

NOISE MAKING MASK

BACKGROUND OF THE INVENTION

The present invention is a novelty item, in the form of an over-the-head face mask having the self-contained components to produce artificial noise apparently emanating from the face portion of the mask. More specifically, a rubber, latex or plastic face mask is provided which camouflages, hides, disguises, etc. the wearer thereof and contains suitable electronic components to produce noise, when and if desired. In the preferred embodiment of the present invention, the speaker, through which the noise is transmitted from the mask, is located within a protrusion of the face mask. The protrusion is itself camouflaged as a integral design feature of the mask itself. In this manner, the speaker is self-contained within the mask and, yet, the location from which the noise is transmitted is located proximal to the face portion of the mask in a quite realistic manner. The noise generated by the face mask can be in the form of musical computer sounding tones, computer sounding monotone language, a recorded series of sounds, or even sounds from the radio. All that is required is electrical components which provide signals to drive a speaker. In the preferred embodiment of the present invention, a speaker is driven by simple electrical components mounted on a circuit board but the circuit can take the form of an integrated circuit. In either case, the electrical components are connected and powered by a power source, in the preferred form, a battery. In addition, the face mask of the present invention provides light emitting diodes located in the pupils of the fake eyes of the face mask which, preferably, blink on and off simultaneously with the noise generation. They, too, are connected to the electrical circuit including the power source and on/off switch.

Face masks are worn by adults and children when attending Halloween parties, masquerade parties or in simple practical jokes or play. They are worn whenever an individual desires a novelty disguise or appearance. The fun of wearing a novelty face mask is often in the effect it has on the viewers of the mask, *their* expression of surprise, shock, horror, etc. The present invention is directed to providing a face mask with a face design camouflaging or disguising the wearer. In addition to the disguise characteristics of the face mask, a noise generator is provided to camouflage or hide the wearer's actual voice. The noise generator can, in the preferred embodiment, take the form of computer sounding tones or high frequencies and, yet, it can also be in the form of transmitting normal AM or FM radio signals. The noise can be computer sounding monotone language, a prerecorded message, musical tones or bells, etc. The present invention relates to providing a novelty face mask of the over-the-head type having a self-contained electrical noise generator including a speaker. The speaker is located immediately proximal to the face portion of the mask in a protrusion, integrally molded in the mask, which protrusion is a disguise feature of the face mask.

DESCRIPTION OF THE PRIOR ART

Over-the-head face masks, novelty masks, or disguise masks are well-known in the art. However, an over-the-head face mask having its own noise making capability has, to Applicant's knowledge, only taken one form. That form contemplates that the speaker, power source or battery and associated integrated circuitry be secured in a plastic molded breastplate hanging down from the neck portion of the face mask and intended to be worn beneath the wearer's clothing. An on/off switch can also be located in the plastic breastplate. With the noise generating components located, as described, the wearer of the mask can, by activating the switch, produce noise, with the sounds emanating from the speaker. A disadvantage of this prior art noise generating mask, however, is that the noise does not appear to come from the face portion of the artificial mask but, rather, appears to come from the chest of the wearer. In this manner, the prior art noise generating mask is not as realistic as is desired by an individual wearing this type of novelty device. Having the sound emitted from the breastplate negatively impacts on the overall effect.

The present invention, on the other hand, contemplates that the speaker and the other electronic parts be self-contained within various portions of the over-the-head face mask, itself, with the speaker, in particular, being located and secured within an appendage which, itself, is an integral disguise feature of the face portion of the mask. In this manner, the speaker is self-contained, and proximally located near the front of the face mask disguise, so that the noise generated and transmitted therefrom has a more realistic sounding location than the breastplate located speaker of the prior art. In addition, by locating the speaker within a disguise feature of the face mask, it is camouflaged. Location of all of the noise generating components within various areas of the over-the-head face mask and specifically the speaker within a disguise protrusion, eliminates the necessity for a bulky and cumbersome breastplate and further eliminates the necessity for the wearer to reach beneath his or her clothing in order to activate or deactivate the noise generating components. In addition, the breastplate arrangement of the prior art noise generating face mask is necessarily located beneath one's bulky clothing, worn in northern climates at Halloween which occurs in the late Fall and, thus, the noise generated through the speaker is severely muffled. The present invention, on the other hand, contemplates that the speaker be located in a protrusion of the face mask, actually a disguise feature of the mask which can be provided with speaker holes through the surface of the face mask which speaker is, nevertheless, located proximal to the face mask and, therefore, the speaker is unmuffled and provides a clear and undistorted noise generating capability at a realistic noise transmitting location. All of this contributes to the realism and effect provided by the present invention.

DESCRIPTION OF THE INVENTION

The present invention relates to an over-the-head face mask which is provided with electrical components capable of providing noise, when desired. More specifically, a rubber, latex or plastic molded face mask is adapted to be worn by an individual by slipping the same over the wearer's head. The face mask is provided with disguise features to present a face either comedic, horrible, a well-known personality, an animal, etc. In one form of the present invention, for example, illustrated in FIG. 1, an alien looking creature has a serpent's head bursting through its forehead. Contributing to the disguise and realism of a face mask, hair is often provided. According to the present invention, the face mask is provided with an electrical noise generating capability with the sound producing speaker through which the noise is transmitted being located within a protrusion which, itself, is integrally molded with and related to the overall disguise features of the face mask. The protrusion is molded with the face mask and is provided with central or internal opening (the protrusion is hollow) of a dimension which is smaller than the diameter or dimension of the speaker. Thus, the speaker can be force-fit by stretching the opening of the protrusion and, yet, after being inserted therein, the central opening being smaller than the speaker, the speaker is maintained with the protrusion. In the preferred embodiment of the present invention, the protrusion is located proximal to the front of the face mask so that the noise or sounds generated and transmitted therethrough appear to come from the face mask and not from the chest of the wearer.

In order to drive the speaker, a battery or power source is connected by hard wiring to the speaker and an on/off switch is provided in series with the power source or battery. Connected to the speaker and providing the noise generating signals is an electrical component circuit which causes the speaker to produce either a series of tones, computer sounding language, prerecorded sounds on audio tape or even, if desired, the electrical circuit could be a radio receiver. In either event, however, noise or sound is generated by the electrical circuit, powered by the batteries and emitted through the speaker. In addition, according to the preferred embodiment of the invention, the power source can be connected to light emitting diodes which are located as pupils within artificial or plastic eyes of the face mask which eyes, when the electrical circuit is completed, will either display constant red lights or, alternatively, the pupils can blink the red light on and off if a timer is connected in series to the light emitting diodes. This, too, enhances the disguise and novelty aspects of the present invention.

Therefore, a speaker is located within a protrusion, integrally molded with the disguise features of the mask. Thus, the speaker and electrical circuitry associated therewith is self-contained within the mask with the speaker located and maintained where desired, i.e., proximal to the face portion of the mask. The other electrical components of the noise generating mask are located between the inside surface of the rear portion of the mask and a fabric liner. A toggle switch pokes through the fabric liner, near the wearer's neck and is easily accessible for turning the noise "on" or "off". The fabric liner is advantageous because it serves to separate the wires and electrical components from the wearer's face and this, too, adds to the safety and comfortability of the face mask, when worn.

According to other embodiments of the present invention, the speaker, located within the integrally molded protrusion of the face mask, is integrally related to the disguise features shown by the face mask, itself, so that the holes desired to facilitate clear and unmuffled sound transmission through the speaker can be provided without detracting from the disguise aspects of the mask. For example, a large bandage could be designed into the design features of the face mask with the breathing holes for the bandage providing the actual holes through which the noise is transmitted from the speaker, located immediately beneath the breathing holes of the bandage. This, too, significantly contributes to the aesthetic and functional aspects of the present invention.

DETAILED DESCRIPTION OF THE INVENTION

Figure 1:
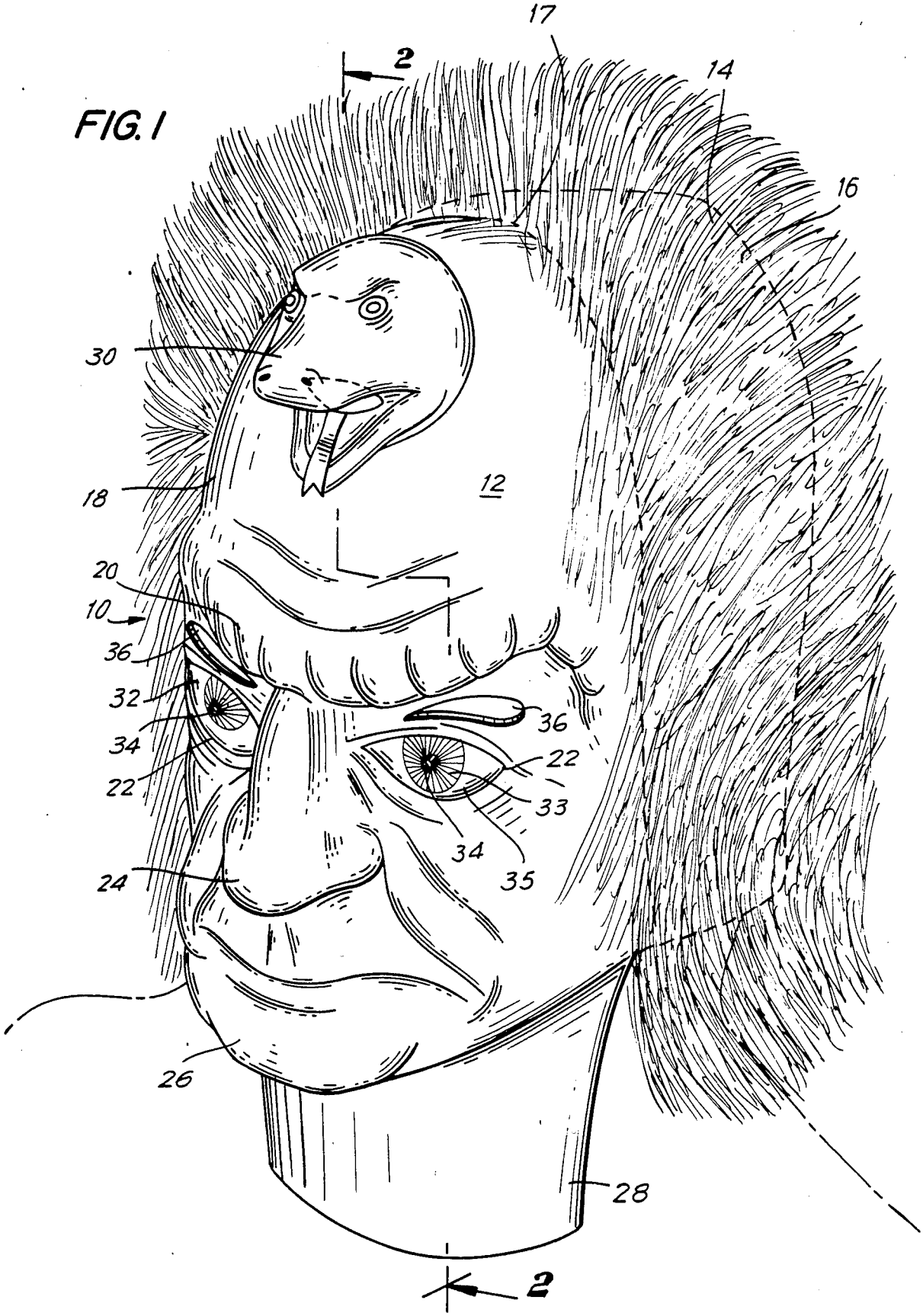
FIG. 1 is a perspective view of the noise or sound generating mask of the present invention.

As best seen in FIG. 1, an over-the-head face mask 10 is sized so as to properly fit over the head of the wearing individual. In this connection, it should be appreciated that the mask 10 of the present invention can be a "one size fits all" size or, alternatively, different size masks can be provided for children and adults. The face mask 10 comprises a face-covering disguise section 12, preferably made from latex, rubber or plastic molded material. The rear of the face mask 10 comprises a rear hood portion 14 which is sewn to the disguise section 12 at seam 17. In an alternate embodiment of the present invention, the disguise section 12 and the rear hood portion 14 can be integrally molded as one piece. Rear hood portion 14 can be provided with fake rooted hair 16 to provide a more realistic appearance to the mask.

Disguise section 12 has a plurality of sections which basically correspond to a human face. For example, a forehead section 18 is provided at the top of the disguise section, with a furrowed eyebrow area 20 located below the forehead section 18. In the shown mask of FIG. 1, the eyebrows are furrowed and clearly separate the forehead section 18 from the lower sections of the face mask. Of course, it should be appreciated that the disguise section 12 can take a variety of artistic embodiments, and therefore, it is quite conceivable that no forehead area or eyebrow section is provided. However, the illustrating embodiment shows the forehead section 18 and the furrowed eyebrow area 20. Located below the eyebrow area 20 is a pair of fake eye sockets 22 which receptively receive plastic or glass oval shaped fake eyes 32. The manner of mounting fake eyes 32 into eye sockets 22 is described in my copending patent application Ser. No. 738,073, filed May 24, 1985. Preferably, the fake eyes are provided with a solid color central portion to provide realistic looking irises 33 and "white" areas of the eye 35. Located centrally in each of the fake irises 33 of the fake eyes 32 is a light emitting diode or red light bulb 34 which is the equivalent of the pupils of the fake eyes. Also, it should be appreciated that a pair of eye slots 36 are provided immediately above the fake eye sockets 22 and below eyebrow area 20, so that the wearer of the face mask 10 can actually see through the eye slots. In this connection, the overhanging or protruding eyebrow area 20 provides a camouflaging or disguising effect for the eye slots 36 and the individual's real eyes seeing therethrough and, therefore, to a casual observer, it appears that the fake eyes 32 are, in fact, the seeing eyes of the wearer. The face-covering disguise section is further comprised of a nose 24 and a mouth area 26. Nose 24 of the face mask 10 is provided with nostril apertures 25 so that the wearer can easily breathe through his nose. The mouth area 26 can be slit open so that the wearer can easily breathe through his mouth. In addition, a neck portion 28 is integrally molded with the disguise section 12.

Figure 2:
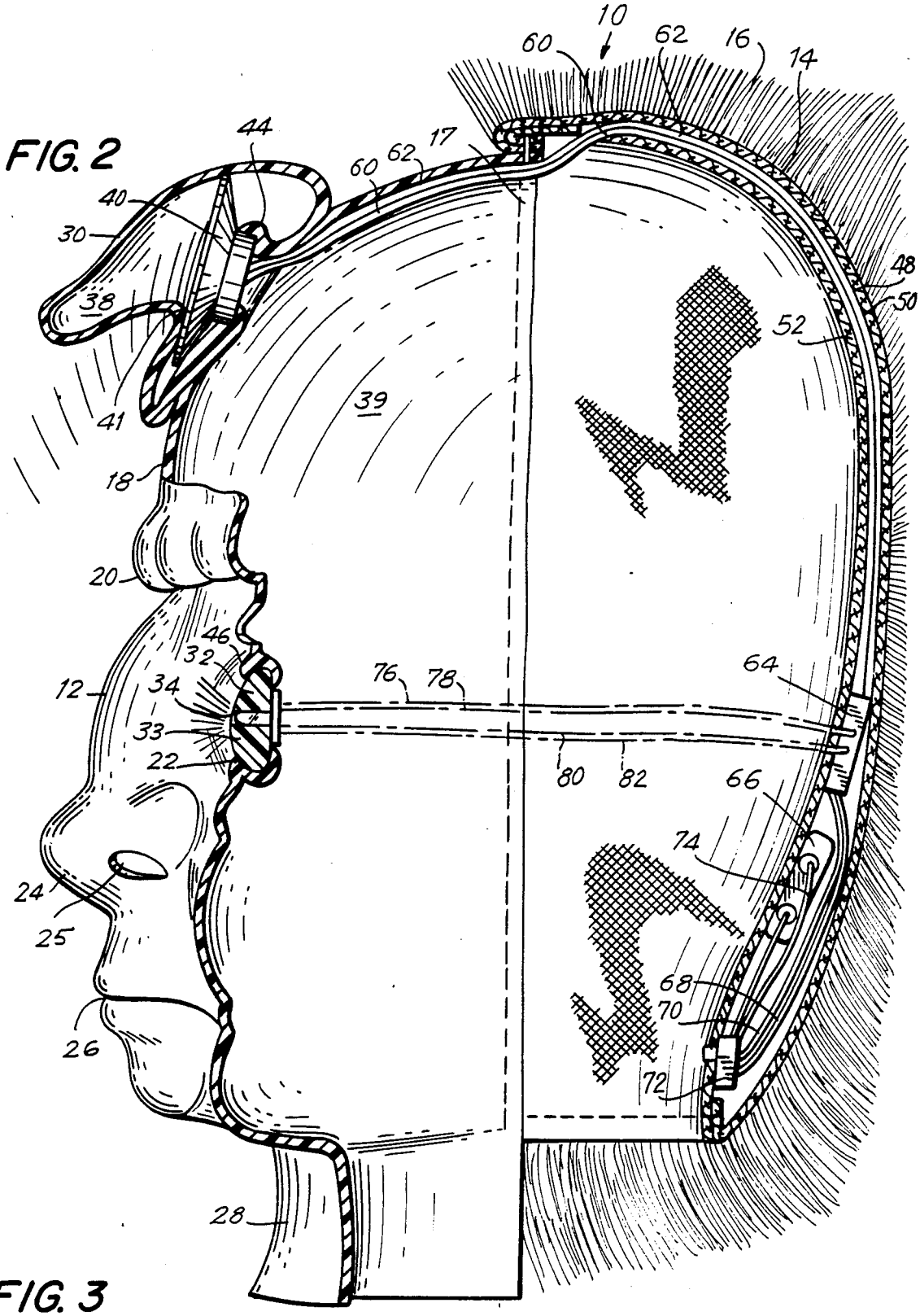
FIG. 2 is cross sectional view of the noise generating mask of the present invention, taken along lines 2—2 of FIG. 1.

In the embodiment shown in FIG. 1, a hollow protuberance 30 is integrally molded into the forehead section 18. In this embodiment, the protuberance 30 is in the form of a serpent's head and located in the face covering disguise section 10. It should be appreciated that the protuberance can be located in any section or portion of the face mask 10. As best seen in FIG. 2, protuberance 30 is hollow and provides a chamber 38 for receptively receiving and maintaining an electrical speaker 40. Protuberance 30 is molded and designed such that the opening 42 connecting chamber 38 with the inside 39 of the face mask 10 is smaller than the size of speaker 40. In this manner, since the protuberance is made from either stretchable plastic or rubber, the speaker 40 can be easily installed by first inserting it from the inside 39 of the mask 10 and then into chamber 38 of protuberance 30 by stretching the opening 42, thereby force-fitting speaker 40. Once the speaker is located in chamber 38 it will be maintained in position. In the embodiment shown in FIG. 2 of the present invention, retaining lips 44 of opening 42 are provided to further secure, in position, speaker 40 in chamber 38. A section 41 of the protuberance 30 serves to hold speaker 40 in position. The protuberance can be provided with holes (not numbered in FIG. 2) for facilitating the transmission of the sound from the speaker. It should also be appreciated that speaker 40 is inserted into chamber 38 of protuberance 30 by passing through opening 42, only once, when the face mask is initially manufactured. Thereafter, the speaker is not touched unless desired to be removed for repair.

FIG. 2 also shows annular retaining ridge 46 for holding, in position, fake eyes 32. Here, again, similar to retaining lips 44 of protuberance 30, the fake eyes are inserted by first stretching apart retaining ridge 46, manually, and then force-fitting through the temporarily enlarged opening, the fake eyes 32. The eyes are maintained in relative position by annular retaining ridge 46.

According to the preferred embodiment of the present invention, the forehead section 18 and the rear hood portion 14 are sewn together as at seam 17. Rear head portion 14 is lined with a fabric liner 52. Fabric liner 52 and the inside surface 48 of rear head portion 14 define an air space 50. Air space 50 provides a convenient passageway for the electrical wiring to be provided to the noise generating electrical component of the present invention.

Figure 3:
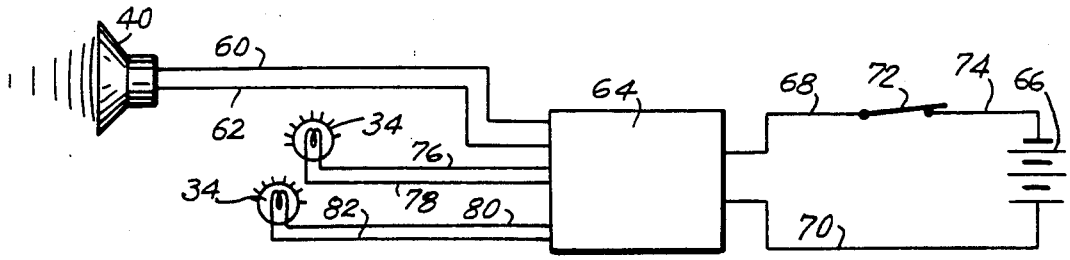
FIG. 3 is a simple electrical schematic of the electrical circuitry showing the components and connecting wiring of the present invention.

As shown in FIGS. 2 and 3, speaker 40 is electrically connected by hard wiring 60 and 62. Wires 60 and 62 pass into air space 50 of rear hood portion 14. An electrical component 64 providing signals to the speaker 40 for producing noise is located in air space 50 at the back and rear of rear hood portion 14. The electrical component 64 can be mounted on a circuit board or can take the form of a small integrated circuit. In either case, electrical component 64 is connected by wire 68 to a switch 72, in the form of a simple on/off toggle switch and then connected by wire 74 to battery or power source means 66. Wire 70 connects the battery or power source means 66 back to the circuit board or electrical component 64. It should also be appreciated that the electrical component 64 for producing signals to speaker 40 for making sounds or noise can, of course, be any electrical mechanism for producing a signal for making noise and, for example, could be a radio, an electronic tone generator or any other mechanism for driving the speaker 40. The light emitting diodes or red lights 34 located in the pupils of fake eyes 32 are connected by wires 76, 78, 80 and 82 to the circuit board 64 which serves to connect the light emitting diodes to battery or power source 66 and to on/off toggle switch 72. The electrical component 64 can, preferably, be provided with suitable electrical circuitry for causing the light emitting diodes 34, when the on/off toggle switch 72 is in its "on" or closed circuit position to periodically flash the light emitting diodes on and off to simulate blinking eyes. Alternatively, however the light emitting diodes or red lights 34 can be directly connected by wires 76, 78, 80 and 82 to the battery of power source 66 and to on/off toggle switch 72, so that they are constantly in an "on" condition when the on/-off toggle switch 72 is in its on or closed circuit position.

It should also be appreciated that wires 76, 78, 80 and 82 serving to connect the light emitting diodes or red lights 34 to the electrical component 64, pass in the air space 50, around the sides of the mask, i.e., the wires travel between thin fabric inside liner 52 and inside surface 48. According the the preferred embodiment of the present invention, the on/off toggle switch 72 is located at the rear base of the face mask with its slide switch poking through fabric liner 52, so that it can easily be reached by the mask wearer.

Figure 4:
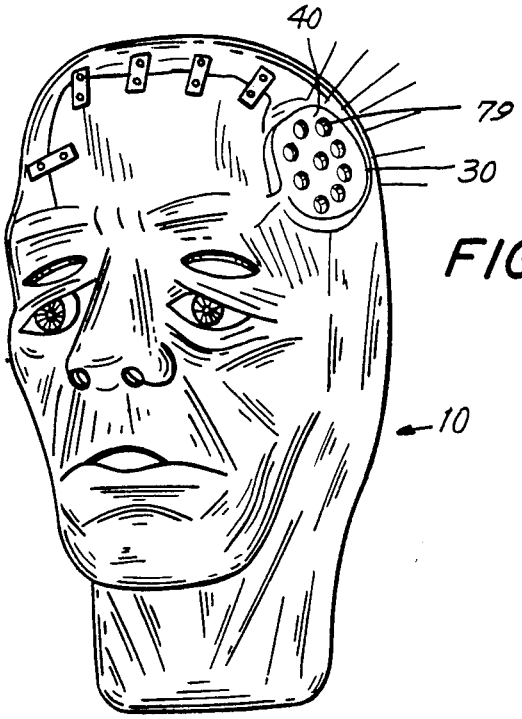
FIG. 4 is a perspective view of a second over-the-head face mask having a different design from that shown in FIGS. 1 and 2 and embodying the present invention.
Figure 5:
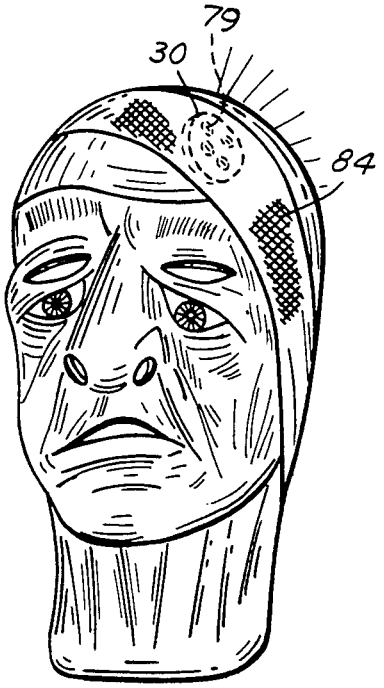
FIG. 5 is yet another embodiment of the over-the-head face mask shown in FIGS. 1, 2 and 4.

FIGS. 4 and 5 show different embodiments of the present invention. It will be appreciated that these two embodiments, like that shown in FIGS. 1 and 2, disclose a speaker 40 being hidden in a disguised protuberance of the face mask which serves to both camouflage the speaker and, in addition, a holding cavity is provided for the speaker located near the front of the mask. In this manner, the sound produced from the speaker is easily audible, unmuffled and realistically appears to emanate from the face mask, not from the chest of the wearer. In FIG. 4, for example, it should be appreciated that speaker holes 79 are provided through the surface of the mask to facilitate transmission of the noise from the speaker 40. In the disguise shown in FIG. 4, the protuberance 30 is actually in the form of a speaker; yet, this, in view of the characteristics of the mask, nevertheless camouflages the actually functional speaker 40. This mask is intended to convey the idea that the "monster" was created from spare electrical components, similar to a Frankenstein creation. According to the face mask shown in FIG. 5, the speaker 40 is located in a protuberance 30 which is designed to constitute a portion of a bandage 84, with the holes 79 through which the noise emanates being the normally provided breathing holes located in the center pad of the bandage. In this manner, too, the speaker 40 is camouflaged as an integral part of the disguise and, yet, the speaker is located towards the front of the mask so that the noise generated therethrough is easily and realistically audible.

In operation, the wearer simply slips the over-the-head face mask 10 over his or her head. The eyes of the wearer will be able to see through eye slots 36 and the wearer's nose can easily breathe through nasal apertures 25 while his or her mouth can, preferably, be capable of breathing through a slit cut into the disguise mouth area 26. With the face mask thus located, an artificial disguise is provided. When the wearer desires to produce a artificial sound from the face mask, he can simply switch the on/off toggle switch from the "off" or "open" circuit position to the "on" or "closed" circuit position by reaching behind his head and sliding the on/off switch 72 to the desired position. With the switch 72 in its closed circuit position, battery or power source means 66 either constantly lights the light emitting diodes or red lights 34, located in fake eyes 32 or, alternatively, the light emitting diodes are put onto a flashing or blinking on/off cycle. In addition, the electrical component 64 for generating signals for driving speaker 40, whether producing sounds by radio transmission, tone generation, computer sounding language or simple high frequency sounds, drives speaker 40 which, therefore, causes sounds to emanate therefrom. Location of the speaker 40 within protuberance 30, an integral portion of the disguise of the face mask, allows the speaker to be hidden and self-contained and, in addition, allows the sound produced therefrom to emanate extremely proximal to the face mask itself in a clear and unmuffled manner. In this way, the over-the-head face mask produced noise in an extremely realistic and highly desired manner.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A noise-generating mask comprising:

(a) a face covering disguise section having a substantially realistically sized human head form fitting disguise area and a rear portion attached to said face covering forming a hollow structure with an inside surface;

(b) a surface abnormality integrally molded into said disguise area;

(c) a speaker mounted within said surface abnormality;

(d) electronic means for driving said speaker to generate a noise;

(e) power means for powering said electronic means and said speaker;

(f) wiring connecting said speaker, said electronic means and said power means;

(g) a pair of fake eyes provided to said disguise section; and (h) said fake eyes being provided with light emitting diodes which are also electrically connected to said power means.

2. A noise generating mask as claimed in claim 1 further comprising:

(a) a thin fabric layer overlays and separates said elements (d), (e) and (f) from the actual face of the wearer of said face mask, said thin fabric layer substantially conforming to the inside surface of the rear portion of said face mask.

3. (New) A noise generating mask comprising:

(a) a face covering disguise section and a rear portion attached to said face covering forming a hollow structure with an inside surface;

(b) a speaker holding pocket made from resilient material and having an opening extending from the inside of said face mask;

(c) a speaker mounted and held within said holding pocket, the width of said speaker being greater than the opening of said speaker holding pocket, yet capable of being placed therein and removed therefrom by stretching said opening;

(d) electronic means for driving said speaker to generate a noise;

(e) power means for powering said electronic means and said speaker; and (f) wiring connecting said speaker, said electronic means and said power means.

4. A face mask as claimed in claim 3, further comprising:

(a) a pair of fake eyes are provided in said disguise section; and (b) said fake eyes are provided with light emitting diodes which are also electrically connected to said power means.

5. A face mask as claimed in claim 3, further comprising:

(a) a thin fabric layer overlays and separates said elements (d), (e) and (f) from the actual face of the wearer of said face mask, said thin fabric layer substantially conforming to the inside surface of the rear portion of said face mask.

* * * * *